US006483412B1

(12) United States Patent
Holdahl et al.

(10) Patent No.: US 6,483,412 B1
(45) Date of Patent: Nov. 19, 2002

(54) TRANSFORMER OR INDUCTOR CONTAINING A MAGNETIC CORE

(75) Inventors: Jim Holdahl, Watertown, SD (US); Todd Settergren, Watertown, SD (US)

(73) Assignee: ConEv Inc., Watertown, SD (US)

( * ) Notice: Subject to any disclaimer, the term of this patent is extended or adjusted under 35 U.S.C. 154(b) by 0 days.

(21) Appl. No.: 09/848,829

(22) Filed: May 3, 2001

(51) Int. Cl.[7] ..... H01F 27/29; H01F 27/30

(52) U.S. Cl. ..... 336/192; 336/208; 336/198; 336/212

(58) Field of Search ..... 336/198, 208, 336/192, 212, 213, 216, 221

(56) References Cited

U.S. PATENT DOCUMENTS

| | | | | | |
|---|---|---|---|---|---|
| 4,352,081 | A | * | 9/1982 | Kijima | 336/198 |
| 4,760,366 | A | * | 7/1988 | Mitsui | 336/233 |
| 5,140,291 | A | * | 8/1992 | Mulder et al. | 336/198 |
| 5,266,916 | A | * | 11/1993 | Kijima | 336/160 |
| 6,154,113 | A | * | 11/2000 | Murai | 336/198 |

FOREIGN PATENT DOCUMENTS

| | | | |
|---|---|---|---|
| DE | 20022209 | U1 | 5/2001 |
| EP | 0 594 031 | A1 | 4/1994 |
| JP | 59-44812 | * | 3/1984 |

OTHER PUBLICATIONS

International Search Report for International Application No. PCT/US02/14172 mailed Jul. 23, 2002.

* cited by examiner

*Primary Examiner*—Anh Mai

(57) ABSTRACT

An electrical device for mounting on a circuit board, such as an inductor or a transformer. The device contains first and second core halves which can be mated to one another. Each half contains an outer skirt attached to a back-plane, and a center core component which is attached to the back-plane in a position which is perpendicular to the back-plane and to the circuit board, when mounted. The center core component has a primary axis and a secondary axis, the secondary axis having a smaller dimension than the primary axis, and a cross-section with a ratio of length of primary axis to length of secondary axis of 1.1:1 to 3.5:1. The outer skirt, back-plane, and center core component all contain magnetic material, e.g. ferrite. A bobbin having a hollow center section with a cross-section of similar shape to the cross-section of the center core components is attached to first and second flanges, each of which flanges has wire mounting posts on its bottom edge. At least one coil is wound around the exterior surface of the bobbin. When the first and second core halves are mated, the center core components are inserted into the center section of the bobbin to form a magnetic core. The coil is attached to at least one pair of wire mounting posts to allow electrical connection to the circuit board.

20 Claims, 2 Drawing Sheets

TRANSFORMER OR INDUCTOR CONTAINING A MAGNETIC CORE

BACKGROUND OF THE INVENTION

1. Field of the Invention

This invention relates to an electrical device, e.g. a transformer or an inductor, which contains a magnetic core, and to a magnetic core half for use in making such a device.

2. Introduction to the Invention

Electrical devices for use as transformers and inductors commonly comprise a magnetic core inserted into a bobbin around which one or more wire coils are wound. When used for power supply, data, or telecommunications applications, such devices are mounted on printed circuit boards (PCBs), along with other electronic components. Due to the large number of components present on the board, it is important that the amount of space occupied by the electrical device be minimized. However, it is also important that the electrical device be appropriately shielded, so as to prevent electrical and magnetic interference with adjacent components.

The conventional approach for reducing the area occupied by the device is to use a smaller conventional part. However, this can give disadvantages in terms of leakage inductance, DC resistance, and total harmonic distortion. Another approach is to mount the wound transformer or inductor in a non-standard orientation, taking advantage of the smallest dimensions available. This approach often requires highly complicated and/or costly mounting fixtures, and the resulting product may be susceptible to radiated emissions, vibration, and/or physical shock. In addition, conventional surface mounting techniques, which use pins or leads extending beyond the edges of the device, increase the space occupied on the board.

A conventional transformer, such as that disclosed in U.S. Pat. No. 4,760,366 (Mitsui), is positioned so that the core, which has a generally flat rectangular shape with curved edges, is parallel to the PCB. It can be mounted onto the board by means of pins. The orientation is such that the height of the device off the board is minimized but the space occupied by the device on the board is at least as large as the largest dimension of the core.

BRIEF SUMMARY OF THE INVENTION

A key factor in determining the footprint occupied by the electrical device is the size and shape of the magnetic core. We have now found that a particular core shape, oriented in a particular way on the PCB, allows a high degree of self-shielding in order to minimize radiated emissions which may affect adjacent components, especially at higher frequencies and drive levels. Therefore, in a first aspect, the invention provides an electrical device for mounting on a circuit board, said device comprising a magnetic core and at least one coil wound around the core, which device comprises (1) a first core half comprising
  (a) a first outer skirt comprising first and second side walls connected by a top wall,
  (b) a first back-plane connected to the first outer skirt to form a semi-enclosed housing, said first outer skirt and said first back-plane comprising a first magnetic material, and
  (c) a first center core component which
    (i) has a primary axis and a secondary axis, the secondary axis having a smaller dimension than the primary axis,
    (ii) has a cross-section with a ratio of length of primary axis to length of secondary axis of 1.1:1 to 3.5:1
    (iii) extends perpendicularly from the first back-plane so that the primary axis is perpendicular to the circuit board when the device is mounted, and
    (iv) comprises a second magnetic material, (2) a second core half is matable with the first core half, and which comprises
  (a) a second outer skirt comprising first and second side walls connected by a top wall,
  (b) a second back-plane connected to the second outer skirt to form a semi-enclosed housing, said second outer skirt and said second back-plane comprising the first magnetic material, and
  (c) a second center core component which
    (i) has a primary axis and a secondary axis, the secondary axis having a smaller dimension than the primary axis,
    (ii) has a cross-section with a ratio of length of primary axis to length of secondary axis of 1.1:1 to 3.5:1,
    (iii) extends perpendicularly from the second back-plane so that the primary axis is perpendicular to the circuit board when the device is mounted, and
    (iv) comprises the second magnetic material, (3) a bobbin which
  (a) comprises an exterior surface and a hollow center section having a cross-section of similar shape to the cross-section of the first and second core components and sized for receiving the first and second core components, and
  (b) is attached to first and second flanges, each of which flanges comprises wire mounting posts on its bottom edge; and (4) at least one coil which is wound around the exterior surface of the bobbin, the first and second core halves being mated so that the first and second core components are inserted into the center section of the bobbin to form the magnetic coil and the coil is attached to at least one pair of wire mounting posts.

The core halves, themselves, also comprise an aspect of the invention. Therefore, in a second aspect, the invention provides a magnetic core half for use in a power supply, or a data or telecommunications circuit which comprises (1) a first outer skirt comprising first and second side walls connected by a top wall, (2) a first back-plane connected to the first outer skirt, said first outer skirt and first back-plane
  (a) comprising a first magnetic material, and
  (b) forming a semi-enclosed shape having a front opening and a bottom opening, and (3) a first center core component which
  (a) has a primary axis and a secondary axis, the secondary axis having a smaller dimension than the primary axis,
  (b) has a cross-section with a ratio of length of primary axis to length of secondary axis of 1.1:1 to 3.5:1,
  (c) is attached to the first back-plane perpendicularly so that the primary axis is perpendicular to a circuit board when mounted on a circuit board, and
  (d) comprises a second magnetic material.

In a third aspect, the invention provides an assembly which (A) an electrical device according to the first aspect of the invention, and (B) a circuit board, said electrical device being electrically connected to said circuit board by means of a wire from the coil wound around the mounting posts.

BRIEF DESCRIPTION OF THE DRAWINGS

The invention is illustrated by the drawings in which.

DETAILED DESCRIPTION OF THE INVENTION

The electrical devices of the invention are suitable for use as an inductor if there is at least one coil present, or as a transformer if there are at least two coils present. In this specification, the word "device" includes both inductors and transformers.

Figure 1:
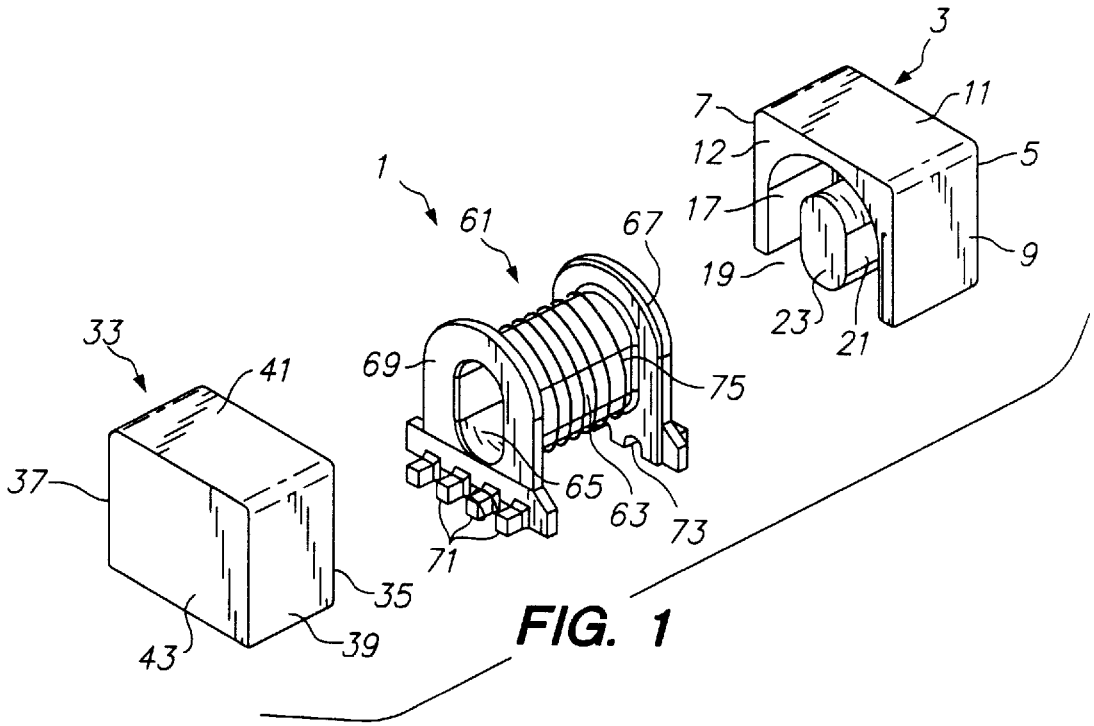
FIG. 1 is an exploded perspective view of an electrical device of the invention.
Figure 11:
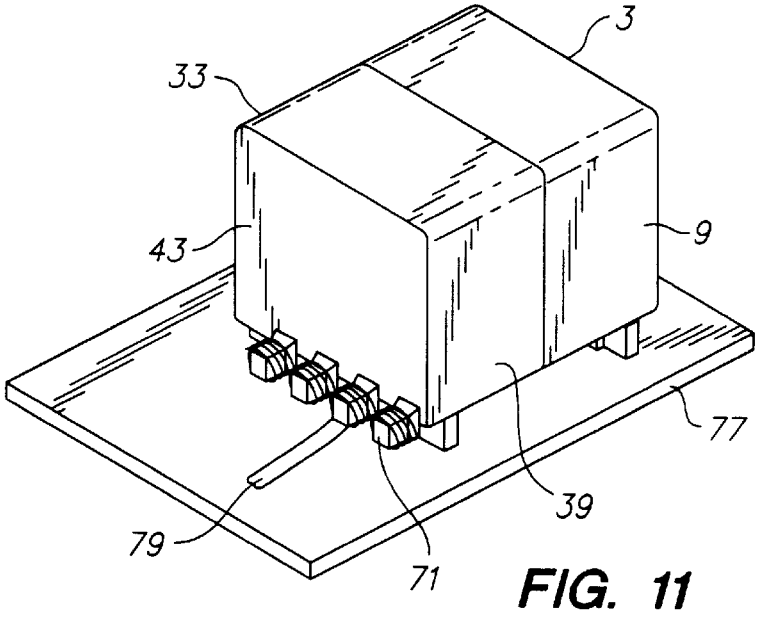
FIG. 11 is a perspective view of an electrical device and assembly of the invention.
Figure 12:
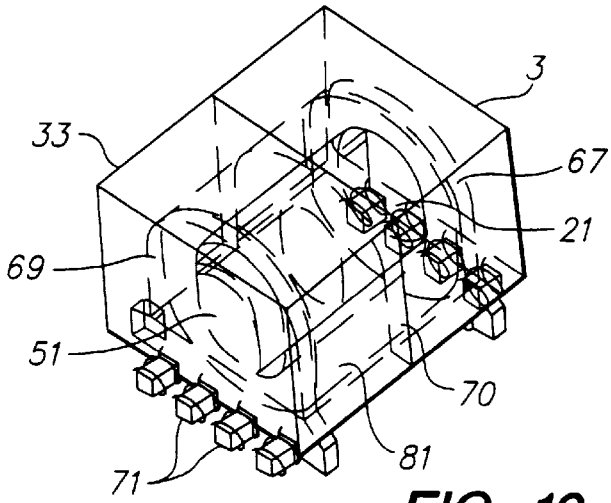
FIG. 12 is a partially transparent view of the electrical device shown in FIG. 11 but not mounted on a circuit board.

FIG. 1 shows an exploded perspective view of a device of the invention, transformer 1. FIGS. 11 and 12 show the assembled device of FIG. 1 (mounted on a circuit board in FIG. 11). As assembled, first core half 3 and second core half 33 are positioned around bobbin 61. For ease of assembly and cost, first and second core halves are preferably identical. First core half 3, which is shown in more detail in FIGS. 2 to 4, comprises a first outer skirt 5 formed from first and second side walls 7,9 connected by top wall 11. In order to maximize shielding and minimize total harmonic distortion, the connections between the side and top walls are curved, not square. First back-plane 13 is attached to first outer skirt 5 to form a semi-enclosed housing, with front opening 17 and bottom opening 19. The front edges of the first and second walls and the top wall form first face 12, which is in a plane with front opening 17. The first outer skirt and first back-plane comprise a first magnetic material.

Figure 2:
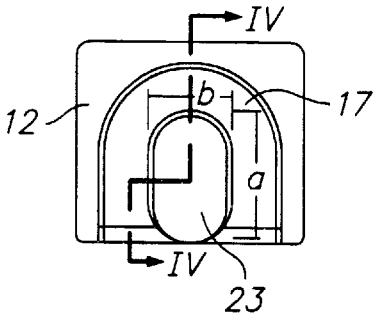
FIG. 2 is a plan view of a magnetic core half of the invention.
Figure 3:
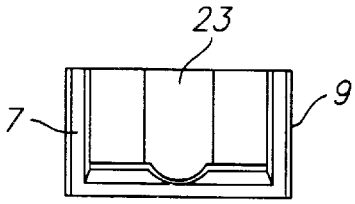
FIG. 3 is a bottom view of the magnetic core half of FIG. 2.

First center core component 21 is attached to and extends from first back-plane 13. If, as is preferred, the first outer skirt, the back-plane, and the core component are manufactured in a single molding procedure, the core component may be integrally attached to the backplane to form a unitary structure. Otherwise, the core component may be attached by any suitable means, e.g. by an adhesive, by direct physical contact which maintains the core component in position by a clip or other article, or by the use of a spacer between the center core component and the back-plane. Rather than being circular or square, the cross-section of the core component is generally rectangular with isometrically opposed semicircular ends or it may be elliptical or oval. The ratio of the primary (i.e. long) axis of the cross-section, shown as "a" in FIG. 2, to the secondary (i.e. short) axis, shown as "b" in FIG. 2, is at least 1.1:1. The ratio is at most 3.5:1, preferably at most 2.7:1, particularly at most 2.5:1, especially at most 2.0:1. If the ratio is greater than 3.5:1, the device will run the risk of mechanical separation due to a very high center of gravity and peeling away from the PCB after installation if subjected to a side-impact test. Typically the length of the primary axis is at most 12.7 mm (0.5 inch), although for most applications it is less, e.g. at most 10.2 mm (0.4 inch), preferably at most 7.6 mm (0.3 inch). Particularly preferred are devices with a ratio of 1.14:1 in which the primary axis has a length of about 4.2 mm (0.165 inch), or 1.81:1 in which the primary axis has a length of about 5.8 mm (0.23 inch).

The position of attachment of the core component to the back-plane is an important aspect of the invention. The core component is attached so that it is perpendicular to the back-plane, as well as perpendicular to the circuit board, when mounted, as shown in FIGS. 1, 2, and 12.

The first core component comprises a second magnetic material. The first and second magnetic materials may be ferrite or ferrous (iron) powder, and the first and second magnetic materials may be the same or different. For example, the semi-enclosed housing may be made from one material, while the core component may be made from another. When the materials are different, attachment means, as described above, may be used to attach the core component to the back-plane.

Figure 4:
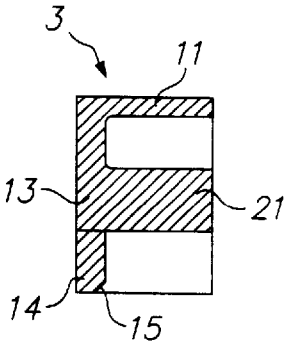
FIG. 4 is a cross-sectional view along line IV—IV of FIG. 2.
Figure 5:
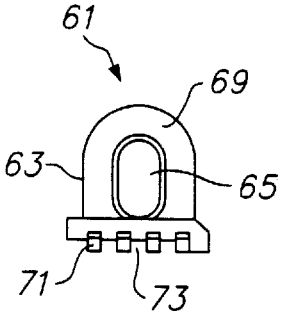
FIG. 5 is a plan view of a bobbin, which is part of the electrical device of the invention.
Figure 6:
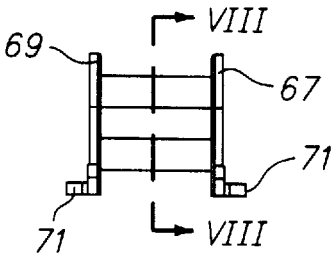
FIG. 6 is a side view of the bobbin of FIG. 5.
Figure 7:
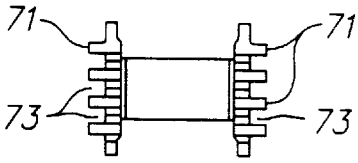
FIG. 7 is a bottom view of the bobbin of FIG. 5.
Figure 8:
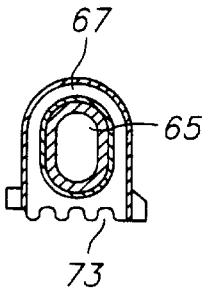
FIG. 8 is a cross-sectional view along line VIII—VIII of FIG. 6.
Figure 9:
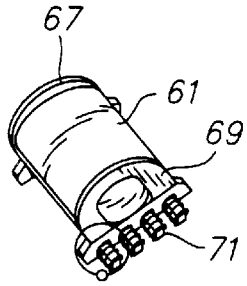
FIG. 9 is an isometric view showing the termination of the wires of the coil of the electrical device of the invention.
Figure 10:
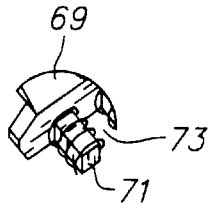
FIG. 10 is an isometric view of a detail of the wire termination shown in FIG. 9.

As shown in FIG. 4, the cross-section of first back-plane 13 has a step 14, and the end of first back-plane 13 has a slanted slope 15 in order to minimize stress placed on the core component during insertion into the bobbin, and, if manufactured by molding, during removal from a die.

The cross-section of first back-plane 13 and first outer skirt 5 should be kept as close as possible to the cross-section of first core component 21, without ever being smaller than core component 21. The cross-section of first back-plane 13 is generally rectangular, while the cross-section of outer skirt 5 has three flat walls on the exterior and a concentrically and coaxially contoured interior. Outer skirt 5 contributes to low distortion and relatively high shielding by core component 21 by maximizing the space directly above the mounting plane on the PCB to provide a high permeability path, as compared to air, to help contain the magnetic flux of the coil as efficiently as possible.

Second core half 33 is preferably identical to first core half 3, although for some applications, the dimensions of the second center core component 51, e.g. length, may be different from that of the first core component 21. Second outer skirt 35 is formed from first and second sidewalls 37,39 connected by top wall 41 and attached to second back-plane 43. As with the first core half, the front edges of the first and second walls and the top wall of the second core half form a second face (not shown in FIG. 1), which is in a plane with a front opening (also not shown). The second outer skirt and second back-plane comprise the first magnetic material of the first core half. Second core component 51 is preferably attached to second back-plane 43 in the same way as first core component 23 is attached to first back-plane 13. The faces of first and second core components 12,42 may be ground or otherwise treated to ensure good physical contact is achieved between the core components when the device is assembled is such contact is desired, and to provide that the faces of the core components are in a plane with the back-plane of each core half. During device operation, the first and second back-planes couple the magnetic flux from the core components to the outer skirts.

Bobbin 61 is shown in FIG. 1 and in more detail in FIGS. 5 to 10. Bobbin 61, generally made from a thermosetting dielectric polymer, has exterior surface 63 and hollow center section 65, which, preferably is of similar shape to the cross-section of the first and second core components. Bobbin 61 is attached to first and second flanges 67,69. Additional flanges or support elements may be present and may be positioned between the first and second flanges, as shown by third flange 70 in FIG. 12. Often one or three additional flanges are present, especially for devices intended for high voltage (e.g. greater than 250 volts) or high frequency (e.g. greater than 500 kHz) applications.

Positioned on the bottom of first and second flanges 67,69 are wire mounting posts or bosses 71. These mounting posts, which are separated by wire routing channels 73, allow separation and control of individual windings around the exterior surface of the bobbin. In addition, the mounting posts allow wires to be terminated easily on the bobbin prior to assembly of the device, and then to be soldered or otherwise attached, directly to the PCB in a self-terminating fashion. Such self-termination can be achieved by exposing the insulated winding wires which have been wound around at least one pair of mounting posts to a temperature or condition sufficient to remove the insulation in the region of the winding to which connection to the PCB is to be made. Such removal can be easily achieved by dipping the wires in solder which is maintained at a temperature above the melting point of the wire insulation. This procedure also serves to solder-coat the wires. The solder-coated wires can then be reflowed onto the circuit board, making electrical connection. As shown in FIGS. 11 and 12, the wire mounting posts do not extend beyond the footprint of the first and second core halves, when assembled to form the device, allowing the maximum use of space. The presence of the wire mounting posts is cost-effective, as no additional metal component is needed as a lead, and, as the mounting posts are located directly under the core, the use of space is optimized. As shown in FIG. 11.

The lack of sharp edges on all the components of the device reduces winding stress, excessive resistance, and excessive leakage inductances. In particular, the smoothly contoured shape of the bobbin lends itself readily to a number of different types of electrical conductors, e.g. square, round, rectangular, and multi-stranded windings. The smooth contours ensure that a minimal amount of space is wasted and volumetric efficiency is kept high, as well as limiting mechanical damage during assembly due to variability of core positioning.

As shown in FIGS. 11 and 12, both first and second core halves 3,33 are assembled over the wire-wound bobbin, with first and second core components 21,51 inserted into the hollow center of bobbin 61. Depending on the application, the core components are designed so that when the first and second core components are assembled in the device to form the magnetic core, they may be in direct physical contact with one another, or there may be gap between them. The first and second faces of the first and second core halves must be in intimate physical contact when fully assembled in order to achieve acceptable performance, i.e. to minimize radiated emissions to adjacent components and reduce product variability. The core halves may be connected by any suitable means, e.g. with adhesive, tape, or a clip. The components of the device are selected so that the magnetic flux in the core preferably does not saturate in normal operation and an acceptable level of distortion is obtained. It is preferred that the magnetic path is relatively uniform in cross-sectional area across its entire length. Furthermore, as assembled, the opening 81 of the device allows mounting in a preferred orientation, i.e. the opening facing the PCB 77 where use of a ground plane can most easily minimize undesirable effects such as radiated emissions or susceptibility to EMI and cross-talk. Also shown in FIG. 11 is a single electrically conductive trace 79 to which electrical connection from a wire wrapped around wire mounting post 71 is attached. Other traces could be present for attachment of other wires.

To optimize the volume utilized by the core structure above a given mounting area, the cross-sectional area of the core composite must be chosen so that acceptable performance, in terms of a given flux density or total harmonic distortion, can be obtained. When fully assembled and mounted on a PCB, it is preferred that the total height of the device from the board be less than 12.7 mm (0.5 inch), as normal card spacing for applications such as telecommunications circuits is 12.7 mm (0.5 inch).

Electrical devices of the invention are particularly useful as transformers or inductors in a power supply, data, or telecommunications circuit. Such telecommunications or data circuits generally operate below 1000 MHz, while power circuits generally have a power output of less than 1000 W.

It will be understood that the above-described arrangements are merely illustrative of applications of the principles or this invention and many other embodiments and modifications may be made without departing from the spirit and scope of the invention as defined in the claims.

What is claimed is:

1. An electrical device for mounting on a circuit board, said device comprising a magnetic core and at least one coil wound around the core, which device comprises (1) a first core half comprising
  (a) a first outer skirt comprising first and second side walls connected by a top wall,
  (b) a first back-plane connected to the first outer skirt to form a semi-enclosed housing, said first outer skirt and said first back-plane comprising a first magnetic material, and
  (c) a first center core component which
    (i) has a primary axis and a secondary axis, the secondary axis having a smaller dimension than the primary axis,
    (ii) has a cross-section with a ratio of length of primary axis to length of secondary axis of 1.1:1 to 3.5:1
    (iii) extends perpendicularly from the first back-plane so that the primary axis is perpendicular to the circuit board when the device is mounted, and
    (iv) comprises a second magnetic material, (2) a second core half is matable with the first core half, and which comprises
  (a) a second outer skirt comprising first and second side walls connected by a top wall,
  (b) a second back-plane connected to the second outer skirt to form a semi-enclosed housing, said second outer skirt and said second back-plane comprising the first magnetic material, and
  (c) a second center core component which
    (i) has a primary axis and a secondary axis, the secondary axis having a smaller dimension than the primary axis, (ii) has a cross-section with a ratio of length of primary axis to length of secondary axis of 1.1:1 to 3.5:1, (iii) extends perpendicularly from the second back-plane so that the primary axis is perpendicular to the circuit board when the device is mounted, and (iv) comprises the second magnetic material, (3) a bobbin which (a) comprises an exterior surface and a hollow center section having a cross-section of similar shape to the cross-section of the first and second core components and sized for receiving the first and second core components, and (b) is attached to first and second flanges, each of which flanges comprises wire mounting posts on its bottom edge; and (4) at least one coil which is wound around the exterior surface of the bobbin, the first and second core halves being mated so that the first and second core components are inserted into the center section of the bobbin to form the magnetic coil and the coil is attached to at least one pair of wire mounting posts.

2. A device according to claim 1 wherein the device is an inductor.

3. A device according to claim 1 wherein the device comprises at least two coils and is a transformer.

4. A device according to claim 1 wherein the first and second core components are in physical contact when mated.

5. A device according to claim 1 wherein the first and second magnetic materials are selected from ferrite material and ferrous powder.

6. A device according to claim 1 wherein the first and second magnetic materials are the same.

7. A device according to claim 1 wherein the first and second magnetic materials are different.

8. A device according to claim 1 wherein the ratio is 1.1:1 to 2.7:1.

9. A device according to claim 8 wherein the ratio is 1.1:1 to 2.5:1.

10. A device according to claim 9 wherein the ratio is 1.1:1 to 2.0:1.

11. A device according to claim 1 wherein the bottom edge of each of the first and second flanges comprises wire guide channels positioned between the wire mounting posts.

12. A device according to claim 1 wherein the first outer skirt, first back-plane, and first core component are a unitary structure.

13. A device according to claim 1 wherein the first and second core halves are identical.

14. A device according to claim 1 wherein the first center core component has a shape with an elliptical cross-section.

15. A device according to claim 1 wherein the first center core component has a shape with a cross-section which is generally rectangular with isometrically opposed semicircular ends.

16. A device according to claim 1 which, when the first and second core halves and the coil-wound bobbin are mated, has an opening parallel to a plane of the circuit board.

17. A magnetic core half for use in a power supply, a data circuit, or a telecommunications circuit which comprises (1) a first outer skirt comprising first and second side walls connected by a top wall, (2) a first back-plane connected to the first outer skirt, said first outer skirt and first back-plane (a) comprising a first magnetic material, and (b) forming a semi-enclosed shape having a front opening and a bottom opening, and (3) a first center core component which (a) has a primary axis and a secondary axis, the secondary axis having a smaller dimension than the primary axis, (b) has a cross-section with a ratio of length of primary axis to length of secondary axis of 1.1:1 to 3.5:1, (c) is attached to the first back-plane perpendicularly so that the primary axis is perpendicular to a circuit board when mounted on a circuit board, and (d) comprises a second magnetic material.

18. A first core half according to claim 17 wherein the first and second magnetic materials are the same.

19. A first core half according to claim 17 wherein the first outer skirt, the first back-plane, and the first center core are a unitary structure.

20. An assembly which comprises (A) an electrical device according to claim 1, and (B) a circuit board, said electrical device being electrically connected to said circuit board by means of a wire from the coil wound around the mounting posts.

* * * * *

UNITED STATES PATENT AND TRADEMARK OFFICE

CERTIFICATE OF CORRECTION

PATENT NO. : 6,483,412 B1
DATED : November 19, 2002
INVENTOR(S) : Holdahl et al.

It is certified that error appears in the above-identified patent and that said Letters Patent is hereby corrected as shown below:

Title page,
Item [73], Assignee, replace "ConEv" by -- CoEv --.

Signed and Sealed this

Eighth Day of April, 2003

JAMES E. ROGAN
*Director of the United States Patent and Trademark Office*